US008763225B2

(12) United States Patent
Bruce et al.

(10) Patent No.: US 8,763,225 B2
(45) Date of Patent: Jul. 1, 2014

(54) SEPARATOR TOOL WITH INDEXING HEAD

(75) Inventors: Michael Bruce, Lutherville, MD (US); Awad Aly Gharib, Cockeysville, MD (US)

(73) Assignee: Apex Brands, Inc., Sparks, MD (US)

( * ) Notice: Subject to any disclaimer, the term of this patent is extended or adjusted under 35 U.S.C. 154(b) by 793 days.

(21) Appl. No.: 12/915,700

(22) Filed: Oct. 29, 2010

(65) Prior Publication Data

US 2012/0102699 A1 May 3, 2012

(51) Int. Cl.
*B25B 11/00* (2006.01)

(52) U.S. Cl.
USPC ..... 29/275; 29/270

(58) Field of Classification Search
USPC ..... 29/275, 270, 278, 244, 255; 254/21, 25, 254/19
See application file for complete search history.

(56) References Cited

U.S. PATENT DOCUMENTS

| | | | | |
|---|---|---|---|---|
| 4,926,537 | A | 5/1990 | Pool | |
| 7,278,626 | B1 * | 10/2007 | Chang | 254/25 |
| 7,628,382 | B2 * | 12/2009 | Cole | 254/25 |
| D634,599 | S * | 3/2011 | Good | D8/89 |
| 8,215,617 | B2 * | 7/2012 | Liou | 254/131.5 |
| 2007/0158626 | A1 * | 7/2007 | Chang | 254/25 |
| 2008/0179576 | A1 * | 7/2008 | Cole | 254/26 R |
| 2010/0140575 | A1 * | 6/2010 | Liou | 254/131.5 |
| 2010/0207082 | A1 * | 8/2010 | Liou | 254/131 |
| 2012/0102699 | A1 * | 5/2012 | Bruce et al. | 29/275 |

* cited by examiner

*Primary Examiner* — Lee D Wilson
(74) *Attorney, Agent, or Firm* — Nelson Mullins Riley & Scarborough, LLP

(57) ABSTRACT

A separator tool including a handle formed a hub at a first end, the hub defining a through bore that is transverse to a longitudinal center axis of the handle, a tool head formed with an integral yoke including opposed first and second legs, the tool head being pivotably coupled to the first end of the handle, an indexing stud slidably disposed within the through bores of the hub and first and second legs of the yoke, and the indexing stud being slidable within the through bores between a first position in which the tool head is secured in a fixed position relative to the handle, and a second position in which the tool head is pivotable relative to the handle.

23 Claims, 7 Drawing Sheets

SEPARATOR TOOL WITH INDEXING HEAD

FIELD OF THE INVENTION

The present invention relates generally to a tool for use in vehicle repairs. More particularly, the present invention relates to a separator tool including an indexing tool head.

BACKGROUND OF THE INVENTION

Tools used for separating components when performing automobile repairs are well known. A typical separating tool may include a wedge-shaped head disposed at a first end of an elongated handle configured to be impacted by another tool, such as a hammer or maul. The wedge-shaped head typically includes a pair of spaced apart, tapered prongs, with the tapered ends configured to be urged between the components to be separated. For example, separator tools are frequently used to separate components, such as tie rod ends and ball joints, from vehicle steering systems. For ease of description, only removal of tie rod ends is addressed here. More specifically, in use, the tapered ends of the prongs are positioned between a tie rod end and the corresponding portion of a drive shaft to which the tie rod end is connected, and the distal end of the handle is struck as necessary, thereby driving the thicker portions of the prongs between the connected components and separating them. As well, various separating tools may include handles that allow the separating tool to be driven by a pneumatic hammer, or like tool. Typically, the tool handles configured for use with pneumatic drivers are more slender, and therefore less sturdy, than the handles that are configured to be struck manually by the user. As such, although it is possible to strike these handles, it is not desirable in that they can be inadvertently damaged.

As would be expected, the separation of various components for different jobs requires variously sized separating tools. The principal difference between the different sized tools relates primarily to the dimensions, spacing and taper of the prongs. Additionally, it is known to vary both the length and diameter of the handles of such separating tools. Even so, as automobile engines have become more complicated in recent years, and excess space more limited within the engine compartment, it is not uncommon for the overall length of the separating tool, dictated primarily by the length of the handle, to prevent a user from having adequate space in which to manually strike the distal end of the handle or attach a pneumatic driver.

The present invention recognizes and addresses considerations of prior art constructions and methods.

SUMMARY OF THE INVENTION

One embodiment of the present invention provides a separator tool including a handle formed with a hub at a first end, the hub defining a through bore that is transverse to a longitudinal center axis of the handle, a tool head formed with an integral yoke including opposed first and second legs, the tool head being pivotably coupled to the first end of the handle such that the hub is disposed between the first and second legs of the yoke and a through bore defined in each of the first and second legs is aligned with the through bore of the hub, and an indexing stud slidably disposed within the through bores of the hub and the first and second legs of the yoke. The indexing stud is slidable between a first position and a second position. In the first position, the indexing stud is fully inserted in the through bores such that the tool head is secured in a fixed position relative to the handle, and in the second position the indexing stud is partially inserted in the through bores such that the tool head is pivotable relative to the handle.

Another embodiment of the present invention provides a separator tool including a handle formed with a hub and a first striking surface at a first end of the handle, the hub defining a through bore that is transverse to a longitudinal center axis of the handle and the first striking surface being disposed on an outer periphery of the hub. A tool head is formed with an integral yoke including opposed first and second legs, and the tool head is pivotably coupled to the first end of the handle such that the hub is disposed between the first and second legs of the yoke and a through bore defined in each of the first and second legs is aligned with the through bore of the hub. An indexing stud is slidably disposed within the through bores of the hub and the first and second legs of the yoke. The first striking surface is configured to be struck with another object.

Another embodiment of the present invention provides a separator tool for separating a first component from a second component, including a handle with a body, a front stop disposed at a first end of the body, a rear stop disposed at a second end of the body, and a weight slidably disposed on the body between the front stop and the rear stop. A tool head includes a fork formed by a pair of substantially parallel prongs, each prong extending outwardly from a proximal end adjacent the first end of the body of the handle to a distal end. The distal ends of the pair of prongs are configured to be positioned between the first component and the second component and the weight is configured to be slid forwardly on the body of the handle, thereby striking the front stop and driving the distal ends of the pair of prongs between the first component and the second component.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
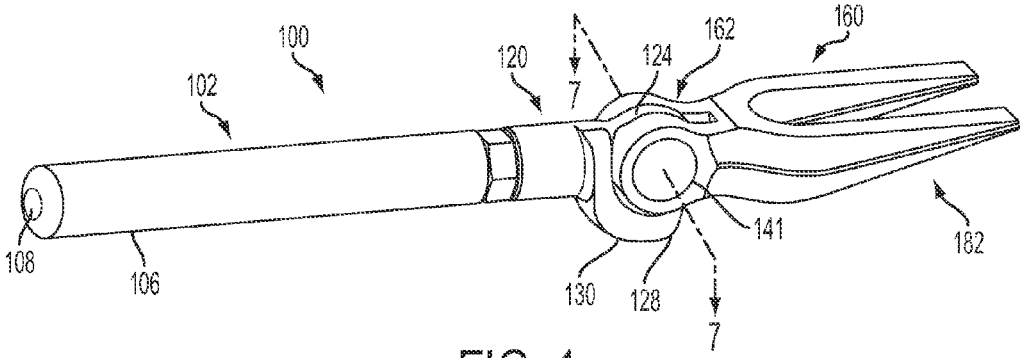
FIG. 1 is a perspective view of an indexing head separator tool in accordance with an embodiment of the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
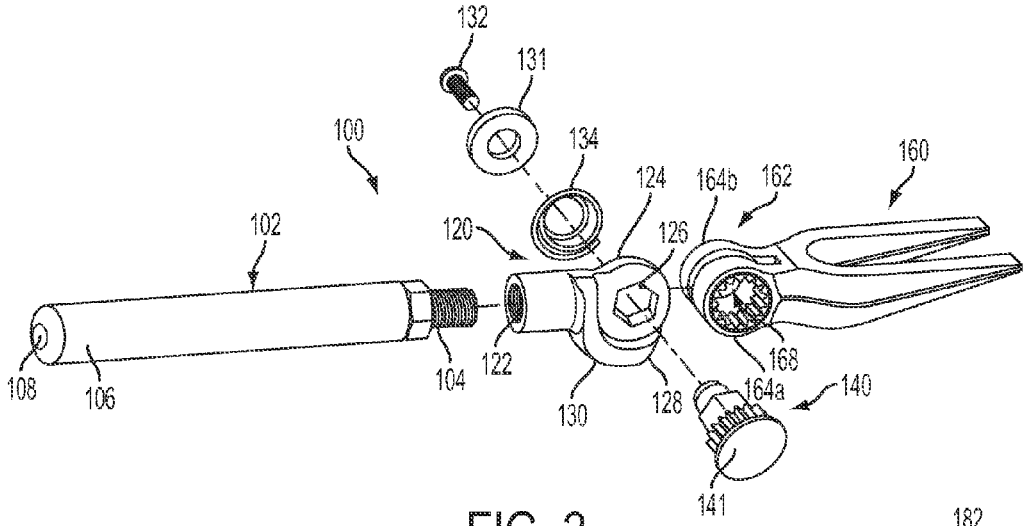
FIG. 2 is an exploded perspective view of the separator tool shown in FIG. 1.

Referring to FIGS. 1 and 2, a separator tool 100 in accordance with the present invention includes a tool head 160 pivotably mounted to a handle 102 such that the angle of tool head 160 relative to the longitudinal center axis of handle 102 may be selectively altered. Tool handle 102 includes a threaded stem 104 at a first end and a striking surface 108 at its second end. A hub portion 120 is removably received on threaded stem 104 and includes a striking surface 130 and a hub 124 that defines a through bore 126. Tool head 160 includes a rearwardly-facing yoke 162 formed by a pair of first and second legs 164*a* and 164*b*, each of which defines a through bore 168. A fork 182 formed by a pair of substantially parallel prongs extends outwardly from yoke 162 of tool head 160. Hub 124 is received in a recess between first and second legs 164*a* and 164*b* of tool head 160 such that through bores 126 and 168 defined by hub 124 and first and second legs 164*a* and 164*b*, respectively, are axially aligned. An indexing stud assembly 140 including a push button 131, a threaded fastener 132 and a coil spring 134 is slidably received in through bores 126 and 168 such that tool head 160 is selectively pivotable relative to handle 102, as discussed in greater detail below.

Figure 3:
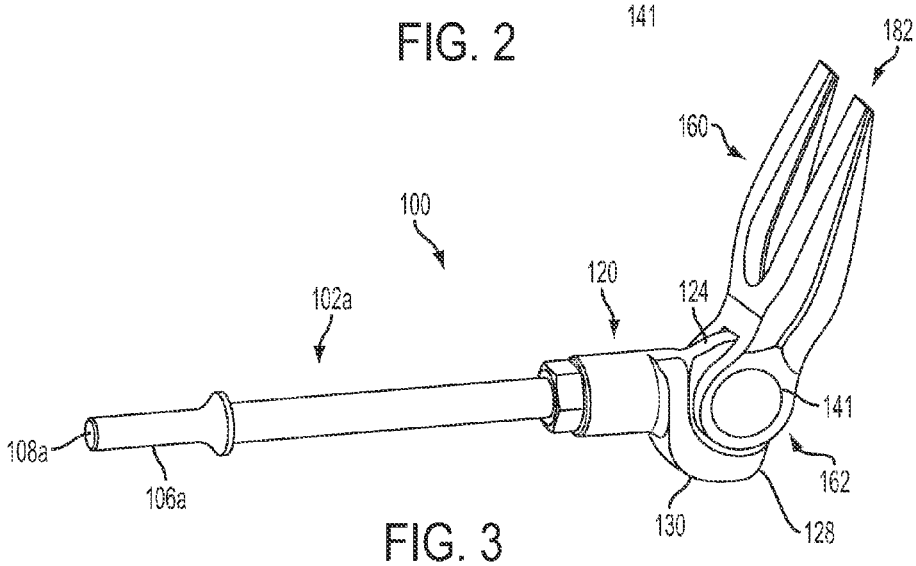
FIG. 3 is a perspective view of the separator tool shown in FIG. 1 with the tool portion locked in an alternate position, with an alternate embodiment of a handle.
Figure 4A:
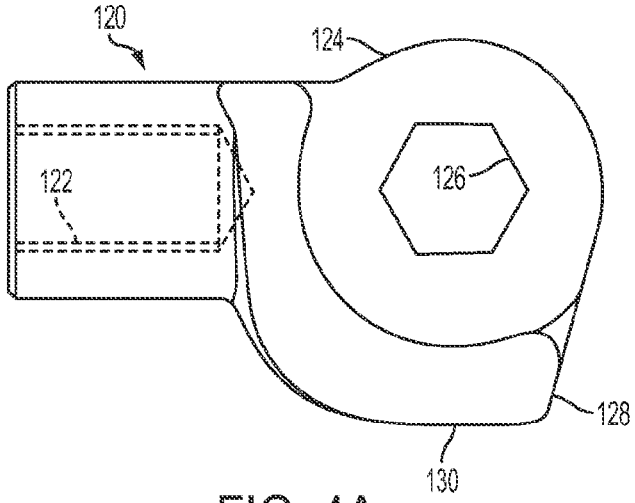
FIGS. 4A, 4B and 4C are side, top and bottom views of the hub portion of the separator tool shown in FIG. 1.
Figure 4B:
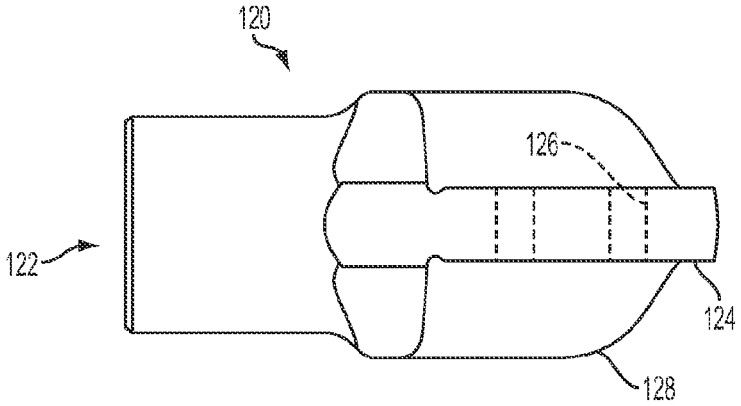
Figure 4C:
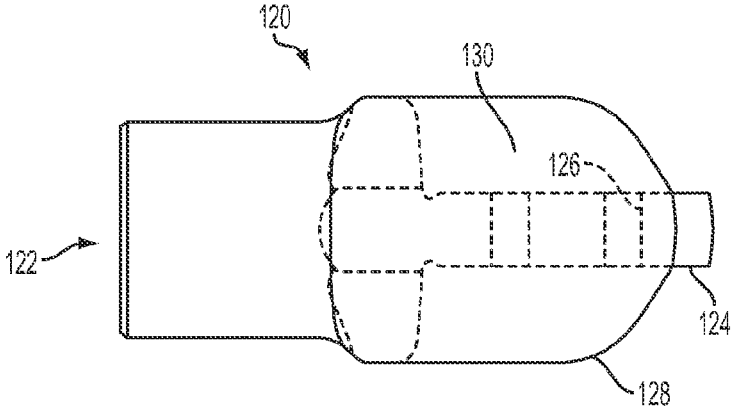

Referring additionally to FIGS. 4A through 4C, hub portion 120 additionally includes a threaded bore 122 and a curved plate 128. Threaded bore 122 is configured to removably receive threaded stem 104 of handle 102, as such, various handles, such as handle 102*a* shown in FIG. 3, may be used with hub portion 120 and the corresponding tool head 160, as needed. Handle 102 (FIG. 1) includes a grip portion 106 that is configured to allow a user to manually strike striking surface 108 with a hammer, maul, or like tool, whereas handle 102*a* (FIG. 3) includes a grip portion 106*a* defining a striking surface 108*a* that is configured to be struck by a pneumatic hammer, or like tool. Note, however, although handle 102*a* is designed for use primarily with pneumatic drivers, it is not uncommon for users to manually strike such handles. Curved plate 128 of hub portion extends along a portion of the peripheral edge of hub 124 and extends outwardly from both sides of hub 124. The inner surface of curved plate 128 is shaped correspondingly to the outer peripheral surfaces of first and second legs 164*a* and 164*b* of tool head 160 and its outer surface defines striking surface 130. Preferably, through bore 126 defined by hub 124 is hexagonally shaped. However, other shapes, such as square, octagonal, etc., may be used.

Figure 5A:
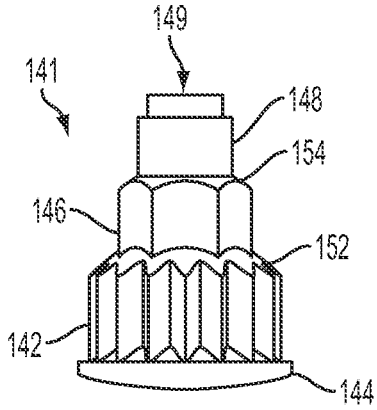
FIGS. 5A and 5B are side and top views of the indexing stud of the separator tool shown in FIG. 1.
Figure 5B:
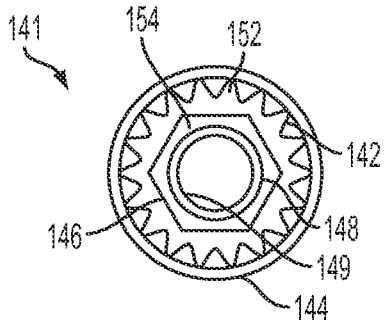

Referring additionally to FIGS. 5A and 5B, indexing stud 141 of stud assembly 140 includes a first end defining a flange 144 and an annular array of locking teeth 142, and a second end defining a smooth shaft 148 and a threaded bore 149. Locking teeth 142 are configured to selectively engage a corresponding annular array of locking teeth 176 (FIG. 7) such that tool head 160 is selectively pivotable relative to handle 102, as discussed in greater detail below. Threaded bore 149 is configured to receive threaded fastener 132 such that push button 131 can be fixed to smooth bore 148 of indexing stud 141. A hexagonal shaft 146 is defined by the central portion of indexing stud 141. Hexagonal shaft 146 is correspondingly shaped to the hexagonal through bore 126 of hub 124 such that indexing stud 141 is non-rotatable relative to hub 124 when hexagonal shaft 146 is received in through bore 126. A crowned portion 152 is defined between locking teeth 142 and hexagonal shaft 146 to facilitate the engagement of locking teeth 142 with locking teeth 176, as discussed in greater detail below. As well, a crowned portion 154 is defined between hexagonal shaft 146 and smooth shaft 148 to facilitate insertion of hexagonal shaft 146 into through bore 126 of hub 124.

Figure 6A:
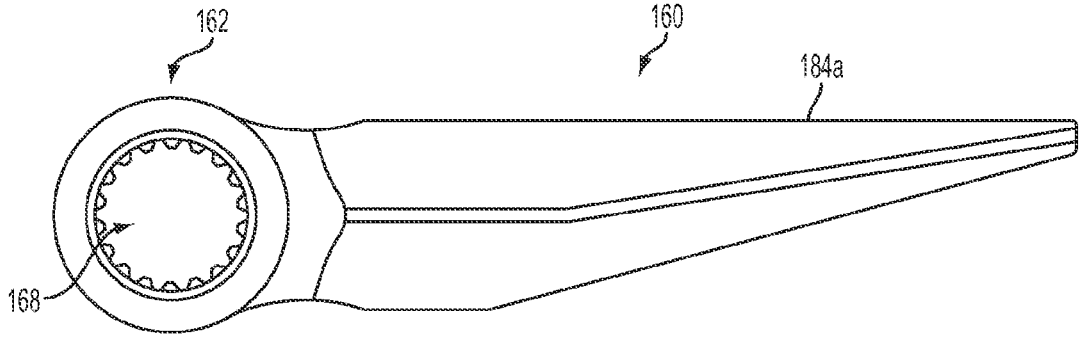
FIGS. 6A, 6B and 6C are side, top and rear views, respectively, of the tool head of the separator tool shown in FIG. 1.
Figure 6B:
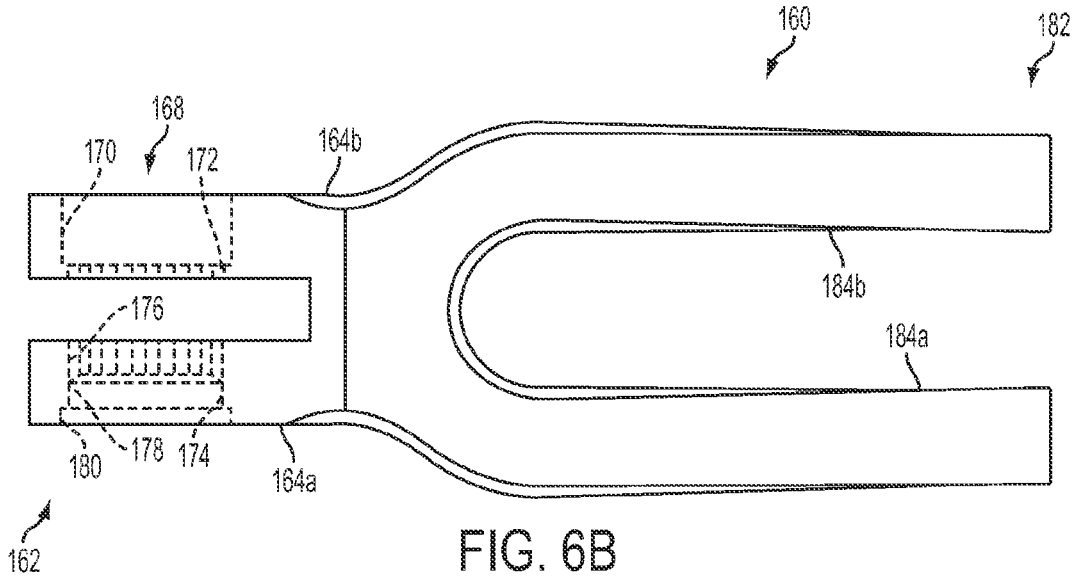
Figure 6C:
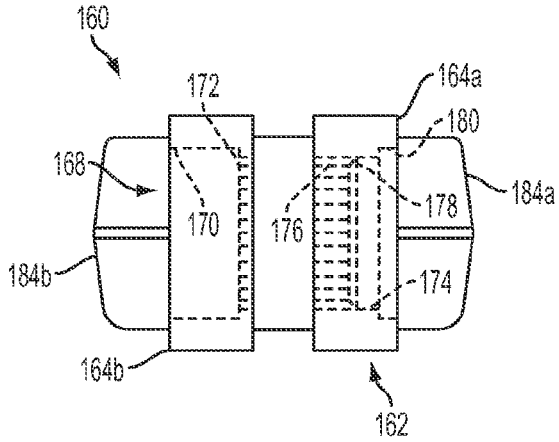

Referring now to FIGS. 6A through 6C, the inner surface of through bore 168 defined by first leg 164*a* defines an annular array of locking teeth 176, a smooth portion 174, a shelf 180, and a crowned portion 178. Shelf 180 is configured to receive flange 144 of indexing stud 141 when indexing stud 141 is in a first locking position, as discussed in greater detail below, thereby limiting the extent to which indexing stud 141 can be inserted into through bores 126 and 168. Locking teeth 176 are configured to selectively receive locking teeth 142 of indexing stud 141 as it is moved between the first position within through bores 126 and 168 in which the position of tool head 160 relative to handle 102 is fixed, and a second position in which tool head 160 is pivotable about hub 124 relative to handle 102. Crowned portion 178 is configured to cooperate with crowned portion 152 of indexing stud 141, thereby facilitating the alignment of locking teeth 142 of indexing stud 141 and locking teeth 176 when engaging the locking teeth 14. Smooth portion 174 has a diameter that allows rotation of indexing stud 141 within through bore 168 of first leg 164*a* when indexing stud 141 is moved to the second position in which locking teeth 142 are disengaged from locking teeth 176.

The inner surface of through bore 168 defined by second leg 164*b* of yoke 162 defines a smooth portion 170 and a toothed portion 172. Smooth portion 170 of through bore 168 is of a diameter that is slightly larger than the outside diameter of push button 131 such that push button 131 can be slidably received within smooth portion 170. Toothed portion 172 is adjacent the inner surface of second leg 164*b* and provides a ledge against which the inner end of coil spring 134 abuts. At no point is toothed portion 172 engaged by locking teeth 142 of indexing stud 141. Rather, toothed portion 172 exists merely from an ease of manufacturing standpoint and results from forming annular array of locking teeth 176 in first leg 164*a*. As shown, fork 182 is formed by two prongs 184*a* and 184*b* that taper from their bases to their distal ends. Additionally, as best seen in FIG. 6A, prongs 184*a* and 184*b* form an angle with the longitudinal center axis of the separator tool 100, and this angle can differ amongst different tool heads.

Figure 7:
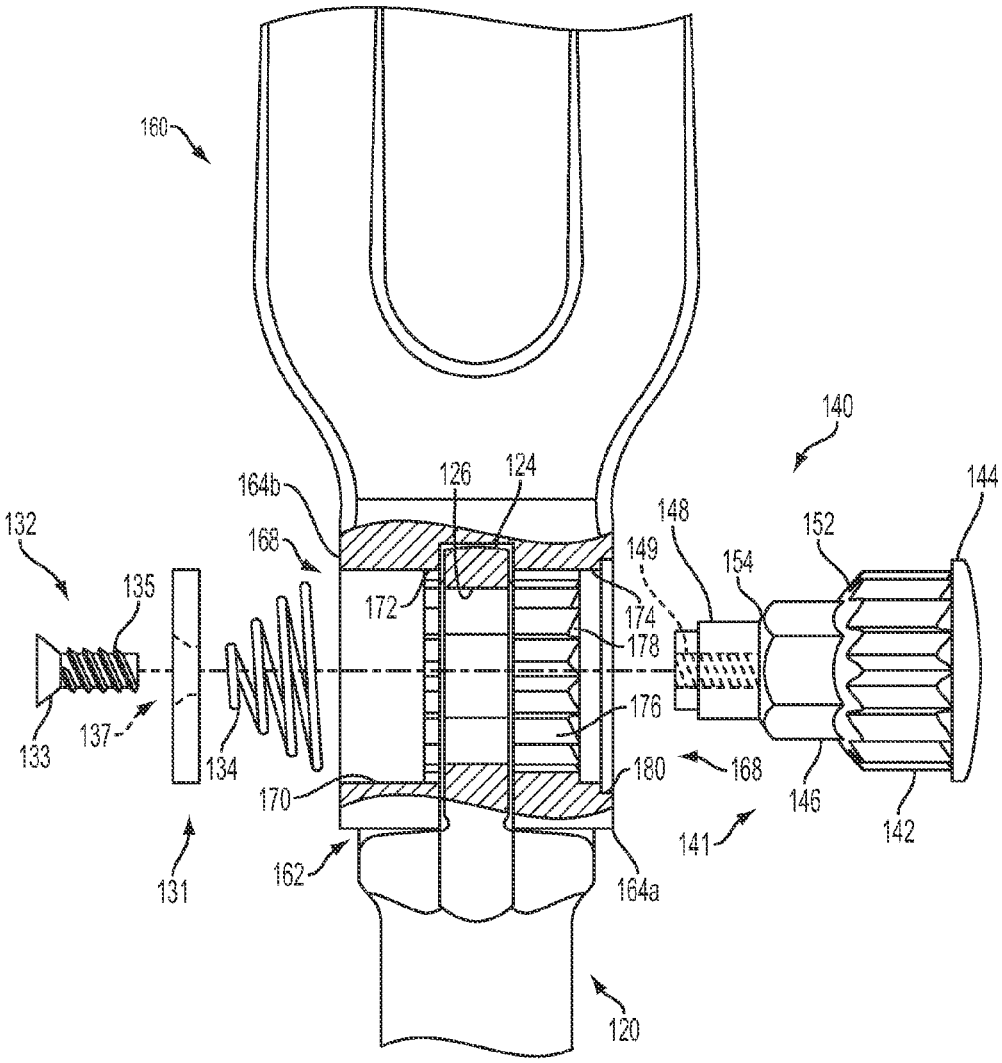
FIG. 7 is a partial, cut-away top view of the separator tool shown in FIG. 1.

Referring now to FIG. 7, when assembled, hub 124 is disposed in yoke 162 of tool portion 160 between first leg 164*a* and second leg 164*b* such that through bore 126 of hub 124 is axially aligned with through bores 168 defined by first and second legs 164*a* and 164*b*. To fully insert indexing stud 141 in separator tool 100, hexagonal shaft 146 of indexing stud 141 must be properly aligned with hexagonal through bore 126 of hub 124, which is facilitated by crowned portion 154 of indexing stud 141. Similarly, locking teeth 142 of indexing stud 141 must be properly aligned with locking teeth 176 of first leg 164*a*, which is facilitated by crowned portions 152 and 178. Once properly aligned, indexing stud 141 is fully inserted until the inner surface of flange 142 abuts shelf 180 of through bore 168 of first leg 164*a*. Next, coil spring 134 is inserted in through bore 168 of second leg 164*b* such that its first end abuts toothed portion 172 and coil spring 134 is disposed about smooth shaft 148. Push button 131 is secured to indexing stud 141 with threaded fastener 132 by engaging threaded bore 149 with threaded portion 135. As shown, threaded fastener 132 also includes a beveled surface 133 that is received in a correspondingly shaped beveled aperture 137 defined by push button 131.

When assembled, viewing the separator tool from the perspective shown in FIG. 7, coil spring 134 acts against the inside surface of push button 131, thereby urging it outwardly from bore 168 of second leg 164*b*. As such, coil spring 134 urges indexing study 141 inwardly into bore 168 of first leg 164*a* until flange 144 abuts ledge 180. In this first locking position, locking teeth 142 of indexing stud 141 are fully engaged with locking teeth 176 of first leg 164*a* and hexagonal shaft 154 is received in hexagonal through bore 126 such that indexing stud 141 is non-rotatable relative to hub 124. As such, tool head 160 is non-pivotably secured to hub 124, and therefore handle 102 of the separator tool. To move indexing stud 141 to the second unlocked position, a user urges push button 131 inwardly into smooth portion 170 of through bore 168 against the biasing force of coil spring 134. As push button 131 is urged into bore 168 of second leg 164*b*, hexagonal shaft 146 slides within hexagonal through bore 126 and locking teeth 142 of indexing stud 141 begin to become disengaged from locking teeth 176 of second leg 164*b*. Eventually, locking teeth 142 become disengaged from locking teeth 176 such that tool had 160 is pivotable relative to hub 124. Note, hexagonal shaft 146 is continuously engaged with hexagonal bore 126 such that indexing stud 141 is not-rotatable relative to handle 102. The user may now pivot tool head 160 relative to hub 124 into the desired position. To fix tool head 160 in the desired position, the user releases push button 131 and coil spring 134 biases indexing stud 141 back into the first locked position.

Figure 8:
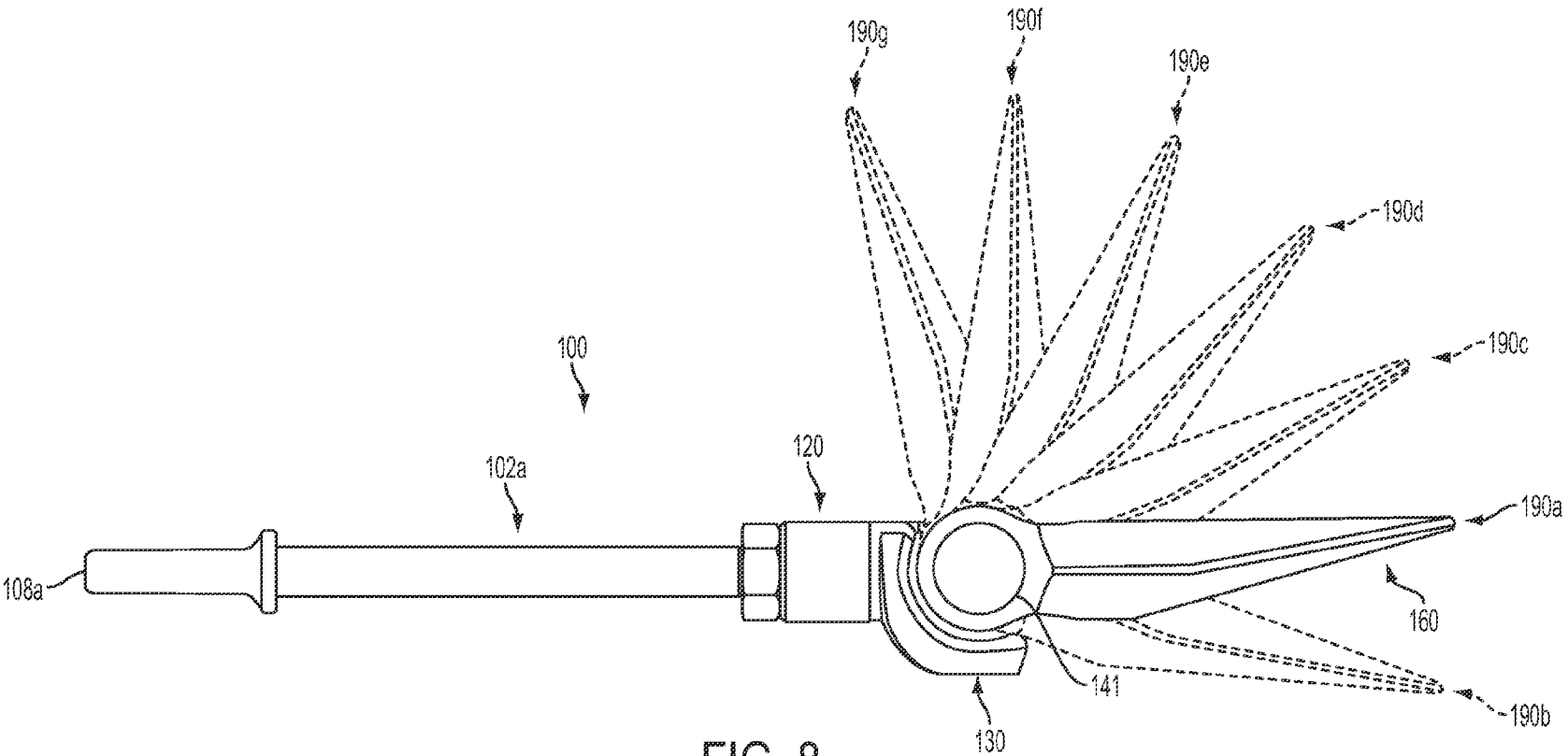
FIG. 8 is a side view of the separator tool shown in FIG. 2 showing the indexing tool portion in various indexable positions relative to the handle.

Referring now to FIG. 8, in the preferred embodiment shown, annular arrays of locking teeth 142 and 176 each include 18 teeth such that tool head 160 can be indexed relative to hub 124 in 20 degree increments 190*a*-190*g*. As such, separator tool 100 can be used in situations where space constraints could impede, or prevent, the use of known separating tools. Additionally, unlike known separating tools in which only the distal end of the handle is configured to be struck, striking surface 130 allows the user to position tool head 160 relative to handle 102*a*, and strike the proximal end of handle 102*a* to which tool head 160 is secured. For example, by placing tool head 160 in position 190*f* relative to handle 102*a* and utilizing striking surface 130, the user can eliminate the length of handle as a potentially limiting factor to the task at hand. Note, the number of teeth in the annular arrays of locking teeth can be varied such that the indexing increment is changed. For example, the annular arrays of locking teeth may each include 12 teeth or 20 teeth, resulting in indexing increments of 30 degrees and 18 degrees, respectively.

Figure 9A:
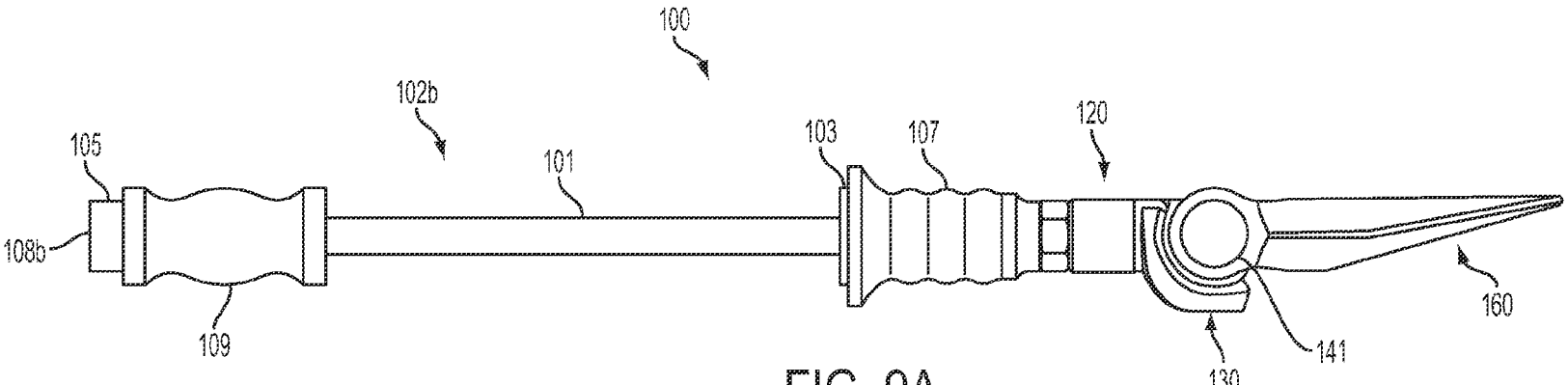
FIGS. 9A and 9B are side views of the separator tool shown in FIG. 1 with an alternate embodiment of a handle.
Figure 9B:
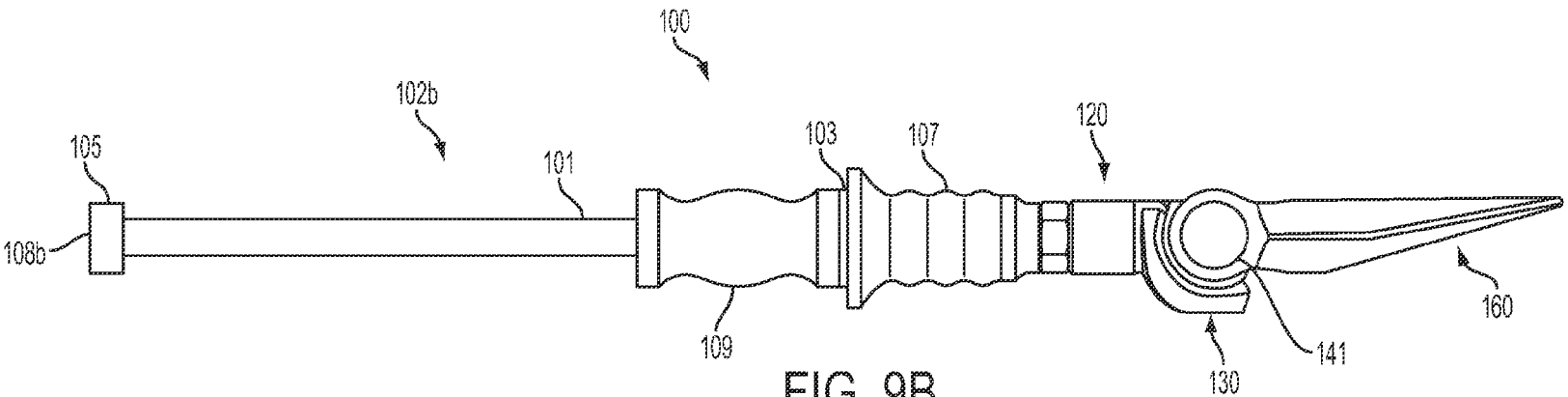

Referring now to FIGS. 9A and 9B, an alternate embodiment of separator tool 100 includes a slide hammer assembly as its handle 102*b*. As shown, the slide hammer assembly includes a body 101, a front stop 103, a rear stop 105, a hand grip 107 and a slide weight 109. Front stop 103 and rear stop 105 are axially and rotatably fixed to body 101, whereas slide weight 109 is rotatably and slidably mounted on body 101 between front stop 103 and rear stop 105. Similarly to the previously discussed handles 102 and 102*a*, the slide hammer assembly is removably secured to hub portion 120 by a threaded stem (not shown). In use, a user positions tool head 160 relative to handle 102*b*, as discussed above with regard to FIG. 8, and positions the distal ends of the tool head 160 prongs between the components to be separated. To separate the components, the user may now hit striking surface 108*b* on the distal end of handle 102*b* or striking surface 130 on hub portion 120. Alternately, rather than striking separator tool 100 with a hammer or like tool, the user may move slide weight 109 rearwardly on body 101 toward rear stop 105 and then rapidly move slide weight 109 forward on body 101 until slide weight 109 strikes front stop 103, thereby delivering separating forces to tool head 160. Hand grip 107 allows the user to maintain separator tool 100 in the desired position relative to the components being separated while operating slide weight 109 with the other hand.

While one or more preferred embodiments of the invention are described above, it should be appreciated by those skilled in the art that various modifications and variations can be made in the present invention without departing from the scope and spirit thereof. For example, the indexing tool head feature can be used with tools other than those used to separate components. As well, the cross-sectional shapes of the through bores and number of teeth formed on the indexing stud and in the through bores can vary. It is intended that the present invention cover such modifications and variations as come within the scope and spirit of the appended claims and their equivalents.

What is claimed is:

1. A separator tool, comprising:

a handle formed with a hub at a first end, the hub defining a through bore that is transverse to a longitudinal center axis of the handle and including a curved plate extending outwardly from an outer periphery of the hub, an outer surface of the curved plate forming a striking surface that is configured to be struck with another object;

a tool head formed with an integral yoke including opposed first and second legs, the tool head being pivotably coupled to the first end of the handle such that the hub is disposed between the first and second legs of the yoke and a through bore defined in each of the first and second legs is aligned with the through bore of the hub; and an indexing stud slidably disposed within the through bores of the hub and the first and second legs of the yoke, the indexing stud being slidable within the through bores between a first position and a second position, wherein in the first position the indexing stud is fully inserted in the through bores such that the tool head is secured in a fixed position relative to the handle, and in the second position the indexing stud is partially inserted in the through bores such that the tool head is pivotable relative to the handle.

2. The separator tool of claim 1, further comprising a first annular array of teeth disposed about an inner surface of the through bore of the first leg and a second annular array of teeth disposed about an outer surface of a first end of the indexing stud, wherein the first and second annular arrays of teeth of the first leg and the indexing stud are engaged when the indexing stud is in the first position and disengaged with the indexing stud is in the second position.

3. The separator tool of claim 2, wherein the through bore defined by the hub further comprises a hexagonal bore and the indexing stud further comprises a correspondingly-shaped hexagonal shaft, wherein the hexagonal shaft is non-rotatably received within the hexagonal bore when the indexing stud is in both the first position and the second position such that the indexing stud is non-rotatably fixed to the hub.

4. The separator tool of claim 2, further comprising a spring disposed within the through bore defined by the second leg of the yoke such that the spring biases the indexing stud into the first position.

5. The separator tool of claim 4, further comprising a push button disposed on a second end of the indexing stud, wherein a user urges the push button inwardly into the through bore of the second leg of the yoke such that the indexing stud is slidably urged into the second position.

6. The separator tool of claim 1, wherein an inner surface of the curved plate is disposed opposite outer peripheral surfaces of the first and second legs of the yoke.

7. The separator tool of claim 1, wherein the tool head further comprises a fork formed by two prongs.

8. The separator tool of claim 7, wherein the tool head may be locked in at least a first position that is substantially perpendicular to a longitudinal axis of the handle such that a portion of the curved plate is disposed opposite to the fork of the tool head.

9. The separator tool of claim 2, wherein the first annular array of teeth of the first leg of the yoke and the second annular array of teeth of the indexing stud further comprise annular arrays of one of 12 teeth, 18 teeth, and 20 teeth, such that the tool head is indexable in one of 30 degree, 20 degree, and 18 degree increments, respectively.

10. A separator tool, comprising:

a handle having a first end formed with a hub and a curved plate extending outwardly from an outer periphery of the hub, an outer surface of the curved plate forming a first striking surface, the hub defining a through bore that is transverse to a longitudinal center axis of the handle;

a tool head formed with an integral yoke including opposed first and second legs, the tool head being pivotably coupled to the first end of the handle such that the hub is disposed between the first and second legs of the yoke and a through bore defined in each of the first and second legs is aligned with the through bore of the hub; and an indexing stud slidably disposed within the through bores of the hub and the first and second legs of the yoke, wherein the first striking surface is configured to be struck with another object.

11. The separator tool of claim 10, wherein the tool head further comprises a fork formed by two prongs.

12. The separator tool of claim 10, further comprising a second striking surface disposed on the second end of the handle.

13. The separator tool of claim 12, wherein the indexing stud is slidable within the through bores between a first position and a second position, such that in the first position the indexing stud is fully inserted in the through bores, thereby securing the tool head in a fixed position relative to the handle, and in the second position the indexing stud is partially inserted in the through bores, thereby allowing the tool head to pivot relative to the handle.

14. The separator tool of claim 10, further comprising a first annular array of teeth disposed about an inner surface of the through bore of the first leg and a second annular array of teeth disposed about an outer surface of a first end of the indexing stud, wherein the first annular array of teeth of the first leg and the second annular array of teeth of the indexing stud are engaged when the indexing stud is in the first position and disengaged when the indexing stud is in the second position.

15. The separator tool of claim 14, wherein the through bore defined by the hub further comprises a hexagonal bore and the indexing stud further comprises a correspondingly-shaped hexagonal shaft, wherein the hexagonal shaft is non-rotatably received within the hexagonal bore when the indexing stud is in both the first position and the second position such that the indexing stud is non-rotatably fixed to the hub.

16. The separator tool of claim 14, further comprising a spring disposed within the through bore defined by the second leg of the yoke such that the spring biases the indexing stud into the first position.

17. The separator tool of claim 14, wherein the first annular array of teeth of the first leg of the yoke and the second annular array of teeth of the indexing stud further comprise annular arrays of 18 teeth such that the tool head is indexable in 20 degree increments.

18. A separator tool for separating a first component from a second component, comprising:

a handle including a body, a front stop disposed at a first end of the body, a rear stop disposed at a second end of the body, and a weight slidably and rotatably disposed on the body between the front stop and the rear stop; and a tool head including a fork formed by a pair of substantially parallel prongs, each prong extending outwardly from a proximal end adjacent the first end of the body of the handle to a distal end, wherein the distal ends of the pair of prongs are configured to be positioned between the first component and the second component and the weight is configured to be slid forwardly on the body of the handle, thereby striking the front stop and driving the distal ends of the pair of prongs between the first component and the second component.

19. The separator tool of claim 18, wherein the handle further comprises a hand grip disposed between the front stop and the tool head.

20. The separator tool of claim 18 wherein:

the body of the handle further includes a hub at a first end, the hub defining a through bore that is transverse to a longitudinal center axis of the handle;

the tool head further includes an integral yoke including opposed first and second legs, the tool head being pivotably coupled to the first end of the body of the handle such that the hub is disposed between the first and second legs of the yoke and a through bore defined in each of the first and second legs is aligned with the through bore of the hub; and an indexing stud slidably disposed within the through bores of the hub and the first and second legs of the yoke, the indexing stud being slidable within the through bores between a first position and a second position, wherein in the first position the indexing stud is fully inserted in the through bores such that the tool head is secured in a fixed position relative to the handle, and in the second position the indexing stud is partially inserted in the through bores such that the tool head is pivotable relative to the handle.

21. The separator tool of claim 20, further comprising a first annular array of teeth disposed about an inner surface of the through bore of the first leg and a second annular array of teeth disposed about an outer surface of a first end of the indexing stud, wherein the first and second annular arrays of teeth of the first leg and the indexing stud are engaged when the indexing stud is in the first position and disengaged with the indexing stud is in the second position.

22. The separator tool of claim 20, further comprising a striking surface disposed on an outer periphery of the hub, the striking surface being configured to be struck with another object.

23. The separator tool of claim 20, wherein the first annular array of teeth of the first leg of the yoke and the second annular array of teeth of the indexing stud further comprise annular arrays of one of 12 teeth, 18 teeth, and 20 teeth, such that the tool head is indexable in one of 30 degree, 20 degree, and 18 degree increments, respectively.

* * * * *